United States Patent [19]

Salvarezza

[11] 4,063,323

[45] Dec. 20, 1977

[54] RING BUOY WITH AUTOMATIC SEPARATION OF SMOKE SIGNAL BUOY FROM STROBE LIGHT BUOY

[76] Inventor: Robert M. Salvarezza, 110 Braemar Drive, Hillsborough, Calif. 94010

[21] Appl. No.: 768,333

[22] Filed: Feb. 14, 1977

[51] Int. Cl.[2] ..... B63C 9/18; B63C 9/20; B63C 9/22

[52] U.S. Cl. ..... 9/14; 9/8.3 E; 9/11 A; 9/313; 9/316; 9/340; 114/190

[58] Field of Search ..... 9/2 A, 8 R, 8.3 R, 8.3 E, 9/14, 11 A, 9, 311, 313, 314, 316, 318, 319, 329, 340; 114/190

[56] References Cited

U.S. PATENT DOCUMENTS

| | | | |
|---|---|---|---|
| 1,087,352 | 2/1914 | Cox et al. | 9/11 A |
| 1,205,033 | 11/1916 | Seely | 9/11 A |
| 3,675,257 | 7/1972 | Haglund et al. | 114/190 |
| 3,754,291 | 8/1973 | Harris et al. | 9/14 |
| 3,812,546 | 5/1974 | Witte | 9/319 |
| 3,945,067 | 3/1976 | Salvarezza | 9/14 |

FOREIGN PATENT DOCUMENTS

| | | | |
|---|---|---|---|
| 902,162 | 2/1961 | United Kingdom | 9/11 A |

*Primary Examiner*—Trygve M. Blix
*Assistant Examiner*—Stuart M. Goldstein
*Attorney, Agent, or Firm*—Owen, Wickersham & Erickson

[57] ABSTRACT

A ring buoy or a life raft that unfurls in water upon being launched. There may be first, second and third ring buoy portions, each having an annular shape of substantially the same inner and outer circumference. The first portion may have a shell containing lightweight material enabling flotation and an extended tube of smoke-generating material, all disposed so that this first portion is weighted to float generally vertically with a smoke-issuing orifice at the top and out of water. The second portion may also have a shell containing lightweight material enabling flotation and may have a flashing light signal, a radar beacon signal, and batteries, all so located that the second portion is weighted to float vertically with the batteries at the bottom and the signals at the top. The third portion may be a normally flat but inflatable tube having an inlet connected to suitable inflating means. Ropes connect the third portion to the first portion and to the second portion, and suitable locking means normally hold the three portions together superposed into one ring buoy assembly. Suitable actuating means cause, upon launching of the buoy, the inflation of the third portion, which then forces the locking means open and separates the three portions for separate flotation, actuates the smoke signal, and actuates the flashing light and the radar beam.

11 Claims, 8 Drawing Figures

FIG. 1
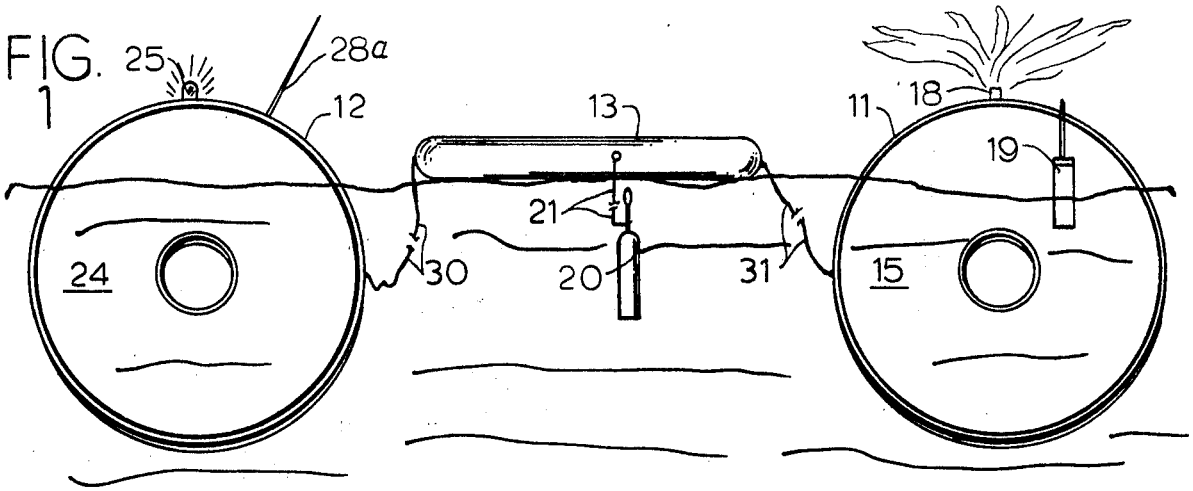
FIG. 2
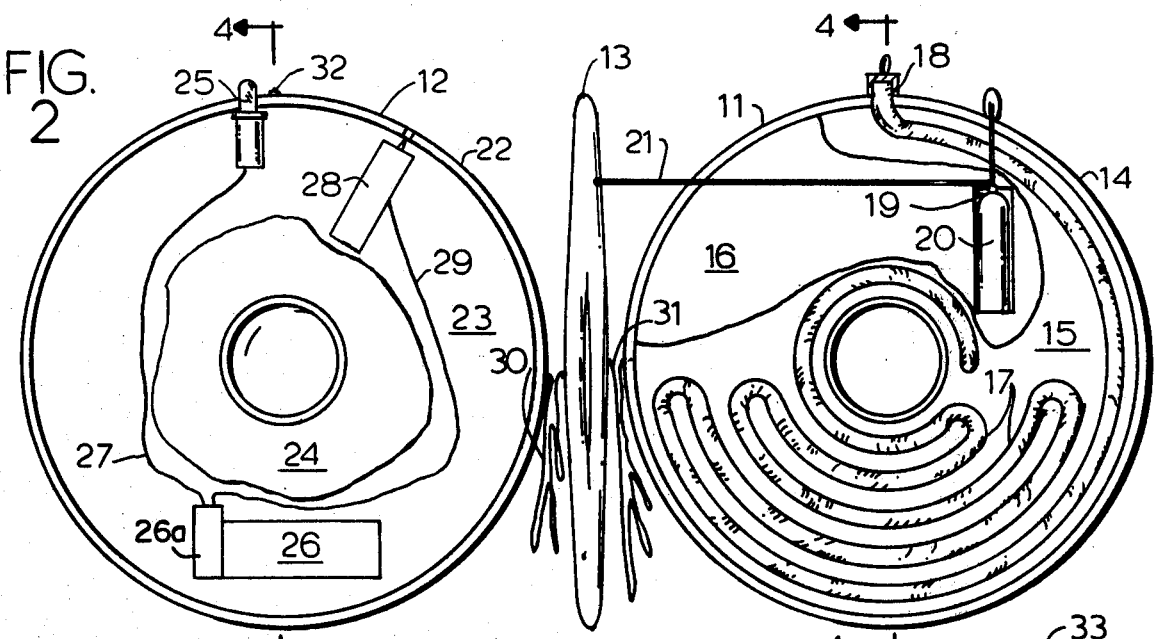
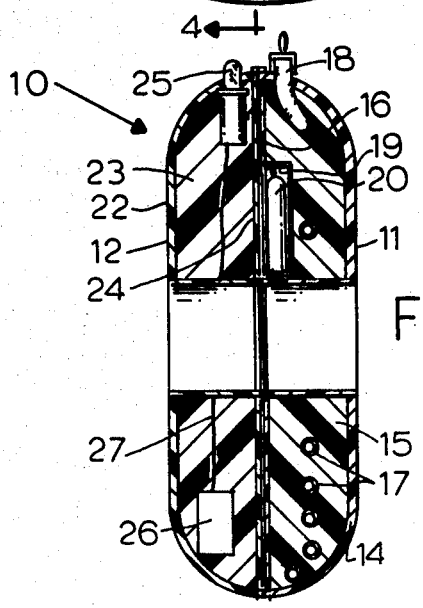
FIG. 4
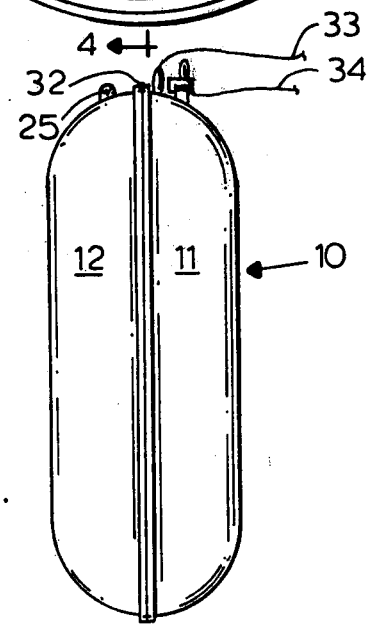
FIG. 3

FIG. 5
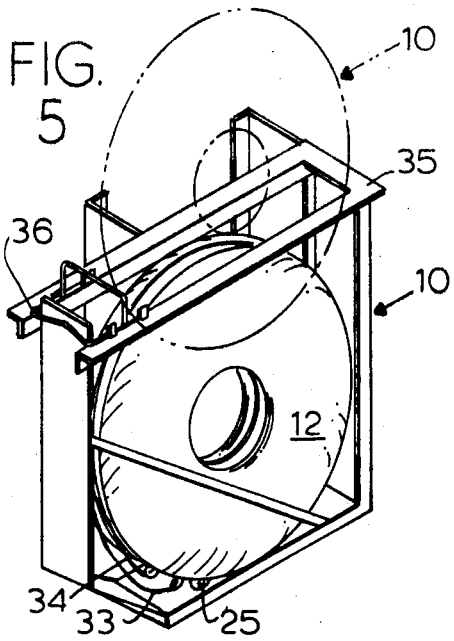
FIG. 6
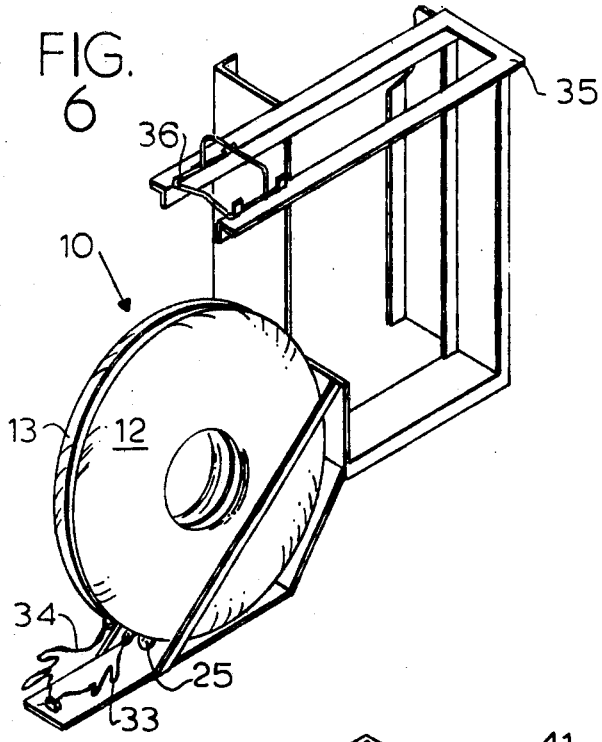
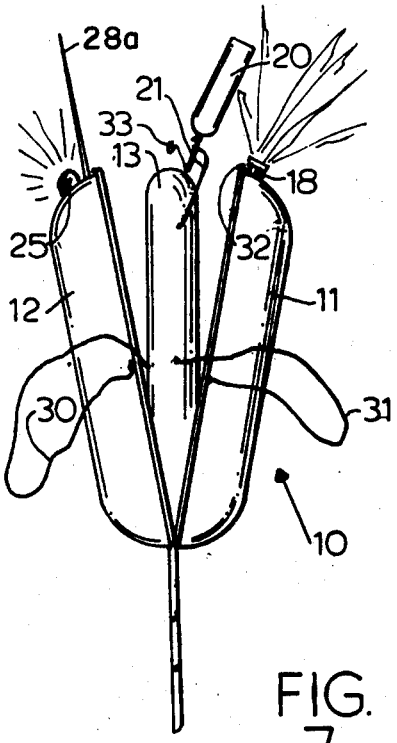
FIG. 7
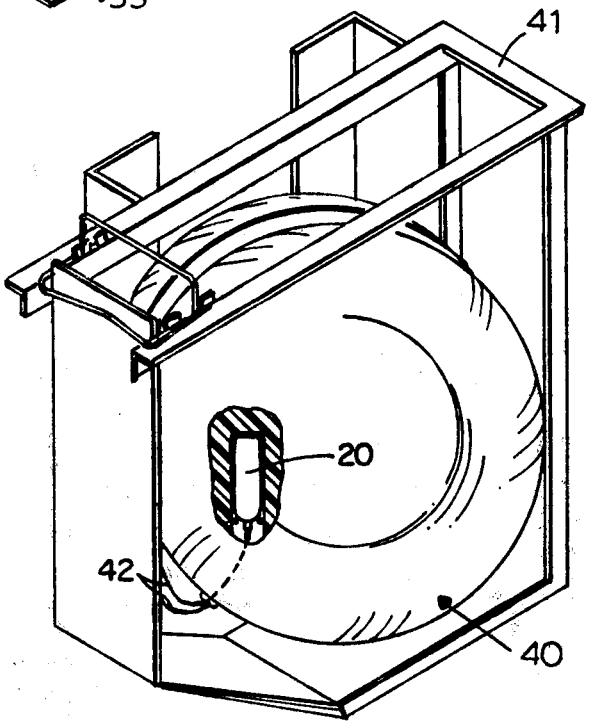
FIG. 8

RING BUOY WITH AUTOMATIC SEPARATION OF SMOKE SIGNAL BUOY FROM STROBE LIGHT BUOY

BACKGROUND OF THE INVENTION

This invention relates to a ring buoy which, when ejected into the water, is automatically separated into three parts: one part is an inflatable ring buoy, a second part is a ring buoy partially filled with a buoyant solid and having a smoke signal of long duration built into it, and the third part is a similar ring buoy partially filled with a buoyant solid and having built into it a flashing light and preferably an emergency radar beacon.

Ring buoys are, of course, well known in lifesaving on the water and particularly in the seas and oceans. When someone falls overboard a ring buoy is thrown to him, or better sent to him, by a device such as is shown in my earlier U.S. Pat. No. 3,945,067. The present invention uses an ejection system substantially identical to that shown in U.S. Pat. No. 3,945,067 with the exception that arrangements are made so that if the ship as a whole sinks, the buoy itself will float to the top and automatically separate into its three parts.

Although the ring buoy shown in U.S. Pat. No. 3,945,067 is associated with a smoke signal, such smoke signals have usually been produced for only about 15 minutes, and it is desirable that the smoke signal be produced over a much longer period. Yet, buoys heretofore have not been capable of carrying with them very bulky equipment needed to provide a 60-minute smoke signal.

The reason why short smoke signals are not considered adequate is that many of the ships today are so large that if a man falls overboard it takes far more than 15 minutes simply to turn the ship around. A smoke signal with a short life may attract sufficient attention to get the ship started turning around, but by then the smoke signal may be gone, and it will then be difficult to help pinpoint the location of the man overboard.

Flashing lights, such as strobe lights, have also been built into ring buoy combinations, as is shown in U.S. Pat. No. 3,945,067. They are useful primarily at night, the smoke signal being relied on during daytime. However, neither the smoke signal nor the strobe light of U.S. Pat. No. 3,945,067 were mounted permanently of the buoy itself, but were strung to it. With such structure, there has been the objection that the smoke signal and the flashing light signal were so close to each other that the smoke tended to veil the flashing light, so that it could not be seen until the smoke had dissipated. In other words, at night the smoke signal tended to veil the light for a time sufficient to prevent one, particularly on a stormy night, from seeing the initial distress signal. By the time the smoke has dissipated, the ship may be too far away for the flashing light to be seen.

In the present invention, structure is provided by which the strobe light and the smoke signal are normally separated from each other, although they are held in tow in the same system. Thus, a man overboard is provided with life-saving support means while at the same time signals are sent out which should make his location highly visible.

Another difficulty with ring buoys heretofore in use was that they floated horizontally. While this is satisfactory from the standpoint of providing an object to cling to, it is not so desirable from the standpoint of emitting smoke signals or sending out light and radio signals. In fact, in some situations the buoy might float upside down and not be properly operative.

Another type self-inflatable life preserver device, wherein a spherical shell splits apart in water to release and inflate a ring buoy, is disclosed in U.S. Pat. No. 3,812,546.

In the present invention, the central inflated portion floats horizontally, but the two other sections, which carry the lights, smoke, etc., are structured to float vertically with the light, radio signal and smoke emission orifice at or near the top.

SUMMARY OF THE INVENTION

The invention comprises a ring buoy made in three parts, of which one is inflatable. One part of the buoy is provided with the usual lightweight buoying materials, such as styrofoam or cork, but in the present invention, these buoying materials are so disposed and counterweighted that the ring buoy portions stand vertically in the water and the signals are located in the upper portions, above water. One part of the ring buoy carries a long-duration smoke signal apparatus. Another large part of the buoy is similarly provided with a flashing light and also with an emergency radar beacon. These two parts are made to be each approximately half a ring buoy; between them is a thin rubber or plastic inflatable ring which takes up very little space when the device is assembled. After the device has been launched, automatically gas is generated to inflate the inflatable ring, and its inflation causes the two elements otherwise together to come apart, so that there are three elements present in the water, all tied together.

Another embodiment of the invention is a complete life raft, rolled up when stowed. On release from the stowing device, the life raft unfurls as it is projected into the water, and it may also include position signalling devices on board.

Other objects, advantages, and features of the invention will appear from the following description of a preferred embodiment.

BRIEF DESCRIPTION OF THE DRAWINGS

In the drawings:

FIG. 1 is a view of the three parts of a ring buoy embodying the principles of the invention, shown after separation. The connecting lines are, of course, much longer and have been broken in order to conserve space.

FIG. 2 is an enlarged view of the three elements, with the central portion shown vertically and the other elements partly broken away to show their interior.

FIG. 3 is a view in elevation of an assembled ring buoy embodying the elements shown in FIGS. 1 and 2.

FIG. 4 is a view in side elevation and in section of the ring buoy of FIG. 3, taken along the lines 4—4 in FIG. 2.

FIG. 5 is an isometric view of the ring buoy of FIGS. 3 and 4 shown as it is normally stowed in a launching arrangement generally like that of U.S. Pat. No. 3,945,067. Broken lines illustrate how the ring buoy can float up and free if the ship should sink.

FIG. 6 is a view similar to FIG. 5 showing the normal launching of the ring buoy.

FIG. 7 is a view in elevation showing how inflation of the central member splits the buoy into three parts.

FIG. 8 is an isometric view of a modified form of the invention.

DESCRIPTION OF A PREFERRED EMBODIMENT

FIGS. 1 to 7 show a ring buoy 10 embodying the principles of the invention. As FIGS. 1 and 2, which are exploded views, show, there are three main portions 11, 12, and 13, all of them ring-shaped and each of them being, in itself, a floatable ring buoy.

The floatable ring buoy portion 11, shaped as half of the complete ring buoy 10, is largely made from a shell 14, and styrofoam 15; it may have a suitable cover 16. The styrofoam 15 is hollowed out partially to enclose a long tube 17 which contains smoke-reacting chemicals in order to give a smoke signal of a desired duration, preferably 15–60 minutes, although it may be longer. The smoke generator 17 may be of a well known and conventional type, such as that shown in U.S. Pat. No. 3,961,259, for example, but of larger capacity. Such larger capacity is enabled by the use of the long tube 17 stored within the buoy half 11. The tube 17 is heavier than the styrofoam 15 and is so located that when the buoy portion 11 is separated from the buoy portions 12 and 13, it tends to stand up generally vertically in the water, with the orifice 18 for the tube 17 at the top, always out of the water, to give forth a better smoke signal. The buoy portion 11 also provides an exterior cavity 19 for retaining loosely a cylinder 20 of pressurized carbon dioxide, which is used to inflate the ring buoy portion 13. After the buoy 10 is split apart, the tube 21, which connects the cylinder 20 to the buoy portion 13, is pulled out of the cavity 19, as shown in FIG. 1.

The second ring buoy portion 12 is shaped as half of the buoy 10 and comprises a shell 22 filled with styrofoam 23 or other buoyant material and may have a suitable cover 24. The styrofoam 23 is hollowed out to contain a flashing light signal 25, while heavy batteries 26 weight the bottom of the buoy portion 12 causing it to float vertically, and holding the lamp 25 at the top. A suitable pair of wires 27 connects the batteries 26 to the lamp 25, and a mercury switch 26*a* may be provided to complete the lamp-battery circuit when the buoy portion 12 is in the vertical position shown. In another part of the buoy portion 12, there is a radar beacon 28 also connected by wires 29 to the batteries 26, via the mercury switch 26*a*. The antenna 28*a* of the radar beacon 28 is spring biased toward its outward position but normally retained in its retracted position by a magnetically releaseable catch (not shown). When the switch 26*a* activates the radar beacon, the magnetic catch releases the antenna to the position shown in FIG. 1, and a signal commences to be transmitted.

The third ring buoy 13 is an inflatable ring tube of suitable rubber or plastic connected to the carbon dioxide cylinder 20 and also connected permanently by ropes 30 and 31 to the two buoy portions 11 and 12.

Once the three members 11, 12 and 13 are manufactured, the buoy 10 is assembled with the two main halves 11 and 12 located on both sides of the inflatable member 13, which is sandwiched between them as shown in FIG. 4. A snap-locking mechanism 32, which may be annular and somewhat like that used in some refrigerator storage plastic containers, may be used to hold the two main halves 11 and 12 together firmly under normal situations, while enabling easy separation when the portion 13 is inflated.

The buoy 10, when assembled, is stowed (see FIGS. 5 and 6) in a device 35 substantially the same as that of U.S. Pat. No. 3,945,067, and is provided with an ejector like that of the patent, so that when a latch 36 is unlocked, from the bridge of the ship, the buoy 10 is, in effect, pitched out. The arrangement is such that pitching out the buoy actuates the cannister 20 of carbon dioxide to cause it to inflate the thin center member 13, as by pulling on a string release (FIGS. 5 and 6). This inflation results in splitting the buoy 10 apart (FIG. 7). The ropes 30 and 31, preferably about 15 to 25 feet long, which are normally housed in each of the two solid members 11 and 12, are both attached to the inflatable member 13 but on opposite sides thereon, so the buoy portions 11 and 12 will tend to be some distance apart from each other.

At the same time, the actuation causes the initiation of the smoke signal 17, the initiation of the flashing light 25, and the radar beacon 28. The initiations may be done by pull cords 33 (carbon dioxide) and 34 (for smoke) that are attached as shown in FIGS. 5 and 6. Normally the portion 12 is stored with the batteries 26 at the top, as shown in FIGS. 5 and 6, so that the mercury switch 26*a* is open and the lamp 25 and radar beacon 28 are inactive. When deployed into the water, the buoy 10 immediately is forced apart and immediately smoke is emitted from the smoke buoy 11 and light and radio signals from the other buoy 12, while the man overboard is able to grab onto any one of the three floating rings 11, 12 and 13. He may use any one of them for support or may hold to the ropes 30 and 31, or do anything that will help him. Since there are three such ring buoy portions 11, 12 and 13, it is quite apparent that several people who are overboard can hang onto the apparatus 10.

Furthermore, the launching device 35 is made such that the ring buoy 10 is quite free to float upwardly, leaving the launching device, if the ship should sink. As a result, the buoy 10 can be made useful when the ship itself sinks and there will be something available for people to grab onto if the sinking is rapid and the people have been unable to get away in life rafts, etc.

It should be understood that the inflatable center member 13 of the ring buoy 10 is a preferred means of separating the two main buoy halves 11 and 12, but that other means may be employed. For example, th e member 13 and the gas source 20 can be eliminated, with the two buoy halves 11 and 12 normally held together by one or more releaseable latches (not shown), released on launching by the pull of the cord 33. The two separated halves may then be connected by one of the lines 30 or 31.

FIG. 8 shows a complete life raft 40 compacted by rolling or a conventional combination of folding and rolling and stowed in a launching device 41 which is, of course much larger than the device 35 for the ring buoy. The life raft 40 is deflated or less than fully inflated. FIG. 8 is not necessarily to scale—the device 41 may be much wider than shown and may actually be wider than shown its length, depending upon how the life raft 40 is compacted and stowed. In the manner of stowing the life raft, the important thing is that the outer periphery of the compacted raft be ring-like or cylindrical, so that it can roll out upon launching.

The launching device 41 of FIG. 8, like the device 35, is substantially the same as that described in U.S. Pat. No. 3,945,067, being provided with the same type ejecting means. Also like the ring buoy launcher 35, the life raft launcher 41 has sufficient clearance at its top that the life raft 40 is free to float upwardly out of the launcher if the ship should sink.

On a normal release, the raft 40 is projected into the water and unfurls to provide a complete life raft which may include automatically actuated signal devices like those of the ring buoy 10. At least one cord 42 is provided (two are shown in FIG. 8), connected to the launching device 41 so that it will pull a release mechanism when the raft is either launched or floats upwardly as the ship sinks. Connected to one cord 42 is a compressed gas container similar to the container 20 of FIGS. 1–7 and connected to inflate the life raft when the release cord is pulled. If automatic signalling devices are included, additional cords 42 can actuate them.

In previous life raft launches, usually two persons were required to heave the raft off the ship and into the water for the rescue of those overboard, and sometimes two persons were not immediately available. The life raft launch of FIG. 8 provides an efficient solution to this problem.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A ring buoy including in combination:

first, second and third ring buoy portions, each having an annular shape of substantially the same inner and outer circumference, said first portion comprising a shell containing lightweight material enabling flotation and a smoke generator having actuating means and a storage tube terminating exteriorly in a smoke-issuing orifice, said tube and lightweight material being so arranged within said first portion that said first portion is weighted to float generally vertically with the smoke-issuing orifice at the top and out of the water, said second portion comprising a shell containing lightweight material enabling flotation and electrically operated signal means, the contents being so located in said second portion that it floats vertically with the signal given at the top out of the water, said third portion comprising a normally flat but inflatable tube having an inlet connected to means for inflating said tube, stowed in said buoy, ropes connecting said third portion to said first portion and to said second portion, locking means normally holding said three portions together superposed into one ring buoy assembly, with the third portion sandwiched between the first and second portions, said locking means being releaseable in response to expansion of the third portion, and actuating means for causing, upon launching of said buoy, (1) inflation of said third portion, which thereupon forces said locking means open thus separating the three portions for separate flotation, (2) initiation of said smoke signal, and (3) initiation of operation of said electrically operated signal means.

2. A ring buoy including in combination:

first, second and third ring buoy portions, each having an annular shape of substantially the same inner and outer circumference, said first portion comprising a shell containing lightweight material enabling flotation and an extended tube of smoke-generating material, said tube and lightweight material being so disposed that said first portion is weighted to float generally vertically with a smoke-issuing orifice at the top and out of the water, said second portion comprising a shell containing lightweight material enabling flotation, a flashing light signal and a radar beacon signal, and batteries, these contents being so located that the second portion is weighted to float vertically with the batteries at the bottom and the signals at the top, said third portion comprising a normally flat but inflatable tube having an inlet connected to a cylinder of carbon dioxide normally stowed in one of said first and second portions, ropes connecting said third portion to said first portion and to said second portion, locking means normally holding said three portions together superposed into one ring buoy assembly, with the third portion sandwiched between the first and second portions, first actuating means for causing, upon launching of said buoy, said carbon dioxide cylinder to inflate said third portion and thereby force said locking means open and to separate the three portions for separate flotation, second actuating means actuated upon launching for actuating said smoke signal, and third actuating means actuated upon launching for actuating said flashing light and said radar beacon.

3. The ring buoy of claim 2 wherein said third actuating means comprises a mercury switch in the electric circuits for the flashing light and the radar beacon, positioned to close the circuits when the second buoy portion floats vertically with the signals at the top, said buoy normally being stored in an inverted vertical position.

4. The ring buoy of claim 3 wherein the radar beacon signal includes an antenna with means for extending the antenna outwardly in response to said third actuating means.

5. A ring buoy including in combination:

a plurality of ring buoy portions, one said portion being inflatable and another portion having signal means thereon, inflation means for said inflatable portion, ropes connecting said portions together, locking means normally holding said portion together superposed into one ring buoy assembly, and actuating means for causing, upon launching of said buoy, (1) said inflation means to inflate said inflatable portion and thereby force said locking means open and to separate said portions for separate flotation, and (2) initiation of said signal means.

6. A ring buoy, including in combination:

first and second ring buoy portions, each having substantially the same outer circumference, said first ring buoy portion comprising a shell containing lightweight material enabling flotation and a smoke generator having actuating means and a storage tube terminating exteriorly in a smoke-issuing orifice, said tube and lightweight material being so arranged within said first portion that said first portion is weighted to float generally vertically with the smoke-issuing orifice at the top and out of the water, said second portion comprising a shell containing lightweight material enabling flotation and electrically operated signal means, the contents being so located in said second portion that it floats vertically with the signal given at the top out of the water, flexible line means connecting the first and second ring buoy portions, locking means normally holding the first and second portions together in one ring buoy assembly, and actuating means for causing, upon launching of said buoy, (1) release of the locking means and separation of the first and second portions, (2) activation of the smoke generator, and (3) activation of the electrically operated signal means.

7. The ring buoy of claim 6 wherein said electrically operated signal means includes a radar beacon and a flashing light signal, said second portion containing a battery connected to the beacon and the signal light and positioned to be in the bottom of the second portion when it is in its floating position, and wherein said actuating means includes a mercury switch connected between the battery and each of the beacon and the signal light and positioned to activate the beacon and the signal light when the second portion is in its floating position.

8. The ring buoy of claim 6 wherein said actuating means includes an inflatable third ring buoy portion normally sandwiched between the first and second portions when the ring buoy is held together by the locking means, and means for inflating said inflatable third portion upon launching of the buoy to release the locking means and separate the first and second portions, said third portion being connected to said flexible line means.

9. The ring buoy of claim 6 wherein the smoke generator has the capacity to generate a smoke signal of from 15 to 60 minutes' duration.

10. The ring buoy of claim 6 which further includes means for stowing and launching the buoy, said means being open at its top to permit free flotation of the buoy out of the stowing and launching means if the ship on which said means is carried should sink.

11. A quick-release device with a compacted, less than fully inflated life raft stowed therein an annular configuration, said device having spacing and support means for securing the device to a bulkhead, a stationary frame supported by said spacing and support means and providing a vertical end wall and pivot means spaced from said end wall, said life raft resting against said end wall, a swingable ramp pivoted to said pivot means with its center of gravity well beyond said pivot means on the opposite side thereof from said end wall, said ramp having a short bottom wall portion, and an end portion, which during stowage is substantially vertical and when vertical retains said life raft, and a connecting portion joining said bottom wall portion to said end portion, with the life raft resting on the bottom portion and connecting portion of said ramp and between its said end portion and said end walls and latch and release means supported by an upper portion of said frame for engaging said ramp's end portion near an upper edge thereof when said end portion is vertical, and having release means for releasing said latch upon a simple upward pull, releasing said upper edge, whereby said ramp seeks its natural center of gravity and swings out around said pivot means and provides a ramp pathway projecting the life raft out and away from a vertical drop and causing it to describe a trajectory that frees it from the ship, said quick-release device being open at its top with sufficient clearance for the compacted life raft to float upwardly and out therefrom if the vessel carrying the quick-release device should sink, and said life raft having compressed gas inflation means with an inflation actuating means connected by a cord to the quick-release device, so that when the life raft exits the quick-release device, the cord pulls the actuating means to cause inflation of the life raft.

* * * * *